US005140747A

United States Patent [19]

Barnett et al.

[11] Patent Number: 5,140,747

[45] Date of Patent: Aug. 25, 1992

[54] METHOD FOR ASSEMBLING A PERISTALTIC PUMP

[75] Inventors: David G. Barnett; Ronald Skinner, both of East Sussex, Great Britain

[73] Assignee: Brightwell Dispensers Limited, Great Britain

[21] Appl. No.: 634,864

[22] PCT Filed: May 8, 1990

[86] PCT No.: PCT/GB90/00711

§ 371 Date: Jan. 29, 1991

§ 102(e) Date: Jan. 29, 1991

[87] PCT Pub. No.: WO90/13743

PCT Pub. Date: Nov. 15, 1990

[30] Foreign Application Priority Data

May 6, 1989 [GB] United Kingdom ..... 8910461

[51] Int. Cl.[5] ..... F04B 43/12

[52] U.S. Cl. ..... 29/888.022; 417/429; 417/475

[58] Field of Search ..... 417/426, 429, 475, 477; 29/888.022, 888.023, 888.025; 418/210

[56] References Cited

U.S. PATENT DOCUMENTS 3,951,570 4/1976 De Biaggi ..... 417/429

4,441,867 10/1984 Berelson ..... 417/475

FOREIGN PATENT DOCUMENTS 8195282 4/1983 Australia .

0078092 5/1983 European Pat. Off. .

1528964 6/1969 Fed. Rep. of Germany ..... 417/429

58-077189 5/1983 Japan .

2107797 5/1983 United Kingdom ..... 417/475

*Primary Examiner*—Leonard E. Smith

*Attorney, Agent, or Firm*—Lucas & Just

[57] ABSTRACT

A method of assembling a peristaltic pump having a motor housing having a driveshaft extending therefrom and a pump housing containing a pump including a rotor mounted on a stub shaft extending through the pump housing wherein the motor housing and the pump housing are detachably connected together. They are assembled by positioning the motor housing and the pump housing so as to axially align the stub shaft and the driveshaft, and moving the pump housing towards the motor housing in the axial direction of the driveshaft so that the driveshaft enters the pump housing and engages the rotor while the stub shaft is urged axially out of the pump housing. When the pump housing contains two or more rotors the stub shaft preserves the alignment of the rotors both during manufacture of the pump assembly and transportation of the pump housing.

1 Claim, 1 Drawing Sheet

METHOD FOR ASSEMBLING A PERISTALTIC PUMP

The present invention relates to pumps, and is principally concerned with pumps for the metered dosing of one of a plurality of liquids.

In many devices there is a need to dispense liquids from reservoirs to a point of use. In industrial dishwashing equipment, for example, peristaltic pumps are conventionally used to dispense firstly detergent and then rinse additives to the wash compartment. Since these dispensing operations call for precisely measured amounts of liquid to be delivered to the wash compartment, separate peristaltic pumps are used for the respective liquids, individually controlled by a timer device.

The object of the present invention is to effect a cost and equipment saving by the provision of a single pump unit capable of selectively dispensing one of two fluids from respective reservoirs to a delivery point, and to facilitate the assembly and maintenance of such a pump.

According to a first aspect of the present invention a dispensing pump for the selective delivery of a fluid from a reservoir comprises a motor having a first housing from which a driveshaft projects, a pumping arrangement contained in a second housing and having an inlet, an outlet, and a rotor, the rotors being mounted on the driveshaft by means of a coupling capable of transmitting torque in one direction only, the first and second housings being detachably connected together to allow separation of the housings in the axial direction of the driveshaft.

The preferred pumping arrangement is a peristaltic pump, but other positive displacement or rotary vane pumps may be used, depending on the fluid to be pumped and the necessity of fine control over amounts pumped. Two rotors may be provided in the second housing their couplings being so configured that when the driveshaft is rotated in a first sense, a first one of the pumping arrangements is activated while the other remains at rest, and when the driveshaft is rotated in the other sense, the other pumping arrangement is activated and the first remains at rest.

In the preferred embodiment, the second housing contains a pair of rotors, two peristaltic tubes extending along arcuate paths in the housing and being occluded at two or more points by pressure between rollers mounted on the rotors and the housing, each rotor being coupled to the driveshaft by means of a respective helical spring wound round the shaft and having one end part extending radially from the shaft to bear on a torque-transmitting surface of the rotor, the helical springs being wound in opposite senses about the driveshaft.

According to another aspect of the invention, a dispensing pump comprising a first housing having a driveshaft extending therefrom and a second housing containing a pumping arrangement including a rotor and wherein the first and second housings are detachably connectable together to allow separation in the direction of the driveshaft axis is assembled by providing a stub shaft extending through the second housing and carrying the rotor, positioning the first and second housings so as to align axially the stub shaft and the driveshaft, and moving the second housing towards the first in the axial direction of the driveshaft so that the driveshaft enters the second housing and engages the rotor while the stub shaft is urged axially out of the second housing. By attaching the rotor to the driveshaft via a unidirectional coupling, the pump may only transport fluid in one direction. Preventing the possibility of the pump operating to transfer fluid in the wrong direction may have important safety aspects, such as when the pump is used in medical applications, for example in dialysis. The two part construction of the pump allows easy and rapid replacement of a faulty or contaminated pump unit, and in the medical application may provide a disposable pump unit to avoid sterilization problems.

Other applications for the 'unidirectional' pump and for the selective dosing pump will become apparent from the following description of a preferred embodiment of the selective dosing pump, in which.

Figure 1:
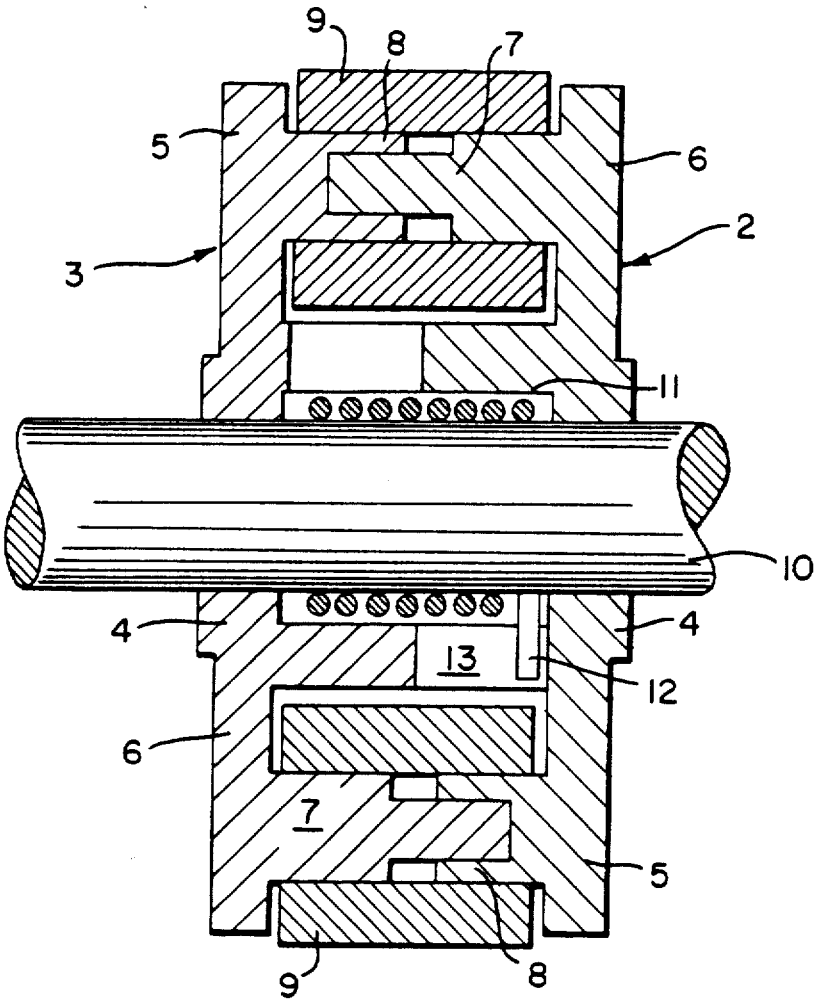
FIG. 1 is a cross-section of a rotor assembly for a peristaltic pump.

Referring now to FIG. 1, the rotor 1 is seen to comprise a pair of identical rotor halves 2, 3 each having a central hub 4 and two opposed radially extending arms 5, 6. At the outer ends of the arms 5, 6 are respectively a spigot 7 and a socket 8 which together form a bearing for a roller 9. A driveshaft 10 passes through the hubs 4, and a spring 11 is wound round the driveshaft 10 between the hubs 4. A radially extending end part 12 of the spring 11 engages in a slot 13 of one of the hubs 4, to provide a torque-transmitting connection between the driveshaft 10 and the rotor.

As in a conventional peristaltic pump, the rollers 9 cooperate with a semicylindrical housing (not shown) to occlude the resilient peristaltic tube, rotation of the rotor causing the occlusion to travel along the tube and drive fluid in the lumen of the tube before it. Clearly, more than two rollers 9 may be provided on each rotor, by having three or more arms extending radially from the hub 4.

The spiral winding of the spring 11 about the shaft is such that a light frictional pressure exists between the spring and the shaft when at rest. In the arrangement shown, rotation of the shaft in a clockwise sense as seen from A will tend to expand the spring, loosening its grip on the shaft and transmitting no torque to the rotor. Rotation of the shaft in the anticlockwise direction as seen from A will have the effect of tightening the grip of the spring on the shaft, and thus the radially extending end part of the spring will transmit a torque to the rotor and the pump will operate.

Figure 2:
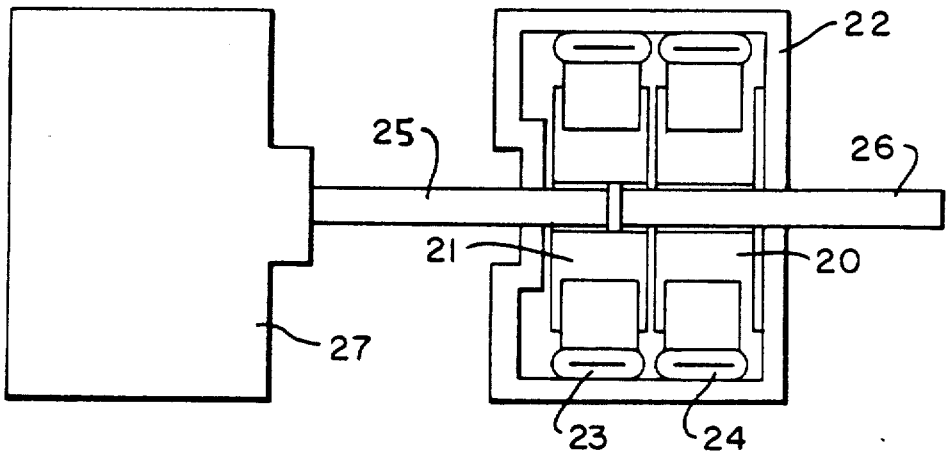
FIG. 2 is a schematic diagram showing the assembly of a two-rotor pump unit.

To produce a selective dosing pump, two rotors such as that shown in FIG. 1 are mounted to a single driveshaft, with their respective springs 10 wound about the shaft. The radially extending parts 12 of the springs are arranged either to be at axially adjacent ends of the two springs, or at the axially remote ends of the springs. This arrangement is seen in FIG. 2, where two rotors 20, 21 are encased in a housing 22 provided with two peristaltic tubes 23, 24, engaged by the respective rotors 21, 20. It will thus be clear that rotation of the driveshaft 25 in a first direction will cause a first one of the rotors to rotate while the other remains stationary, and rotation in the opposite direction will cause the first rotor to remain stationary while the other rotates. By suitably connecting the ends of the peristaltic tubes 23, 24, the pump can be made to deliver fluid selectively from one or other of two reservoirs, depending only on the direction of rotation of the driveshaft.

Clearly, more than two rotors may be used if the required flow rate for either fluid to be dosed exceeds that attainable with a single peristaltic tube.

In the embodiment shown in FIG. 2, a pair of rotors 20, 21 suitably mounted on a stub shaft 26 is sealed into a housing 22 containing the peristaltic tubes 23, 24 and having clearly marked 'inlet' and 'outlet' ports (not shown) for each tube. The pump assembly is connected to an existing motor driveshaft 25 by aligning the stub shaft 26 and the driveshaft 25, and axially sliding the pump assembly on the driveshaft 25 so that the driveshaft enters to extend through the housing 22 of the pump assembly, while ejecting the stub shaft 26. Housing 22 is then fixed to the motor housing 27 from which the driveshaft 25 extends.

Using this configuration, alignment of the rotors 20, 21 is preserved both during manufacture of the pump assembly and transport to the end user for installation.

Clearly the principle of operating two pumps selectively from a single shaft depending on the direction of rotation of the shaft is applicable in many fields, such as for example dishwashers, washing machines, car windscreen washers, etc. It will also be understood that the particular construction of the unidirectional coupling is not of central importance, and the helical spring described may be replaced by a ratchet, a Spragg clutch, or any other suitable coupling. Similarly, the peristaltic pumps may be replaced by gear pumps, vane pumps or any other rotary device.

The rotor described is advantageously moulded from synthetic plastics material, preferably acetal. The rollers may be of plastics or metal, and the housing of the pump assembly is preferably of rigid plastics.

We claim:

1. A method of assembling a dispensing pump, said dispensing pump comprising a motor having a first housing from which a driveshaft projects, at least one pumping arrangement contained in a second housing, each said pumping arrangement having at least one rotor, said method of assembling comprising the steps of providing a stub shaft extending through the second housing and to which at least one rotor of the at least one pumping arrangement is mounted, positioning the first and second housings so that the driveshaft and stub shaft are in axial alignment and end to end contact, moving the first and second housings together in the axial direction of the driveshaft so that the driveshaft enters the second housing to engage the at least one rotor and urges the stub shaft out of the second housing, and fixing the first and second housings relative one to the other.

* * * * *